US006892531B2

(12) United States Patent
Rim

(10) Patent No.: US 6,892,531 B2
(45) Date of Patent: May 17, 2005

(54) SYSTEM FOR AND METHODS OF OPERATING DIESEL ENGINES TO REDUCE HARMFUL EXHAUST EMISSIONS AND TO IMPROVE ENGINE LUBRICATION

(76) Inventor: Julius J. Rim, 7405 Sandy Creek Ct., Bloomfield Hills, MI (US) 48301

( * ) Notice: Subject to any disclaimer, the term of this patent is extended or adjusted under 35 U.S.C. 154(b) by 0 days.

(21) Appl. No.: 10/405,177

(22) Filed: Apr. 2, 2003

(65) Prior Publication Data

US 2004/0194454 A1 Oct. 7, 2004

(51) Int. Cl.[7] ..... F01N 3/00

(52) U.S. Cl. ..... 60/295; 60/274; 60/278; 60/297; 60/311; 60/287

(58) Field of Search ..... 60/274, 297, 278, 60/311, 295, 287; 44/358, 359, 366

(56) References Cited

U.S. PATENT DOCUMENTS

| | | | | | |
|---|---|---|---|---|---|
| 4,417,561 | A | | 11/1983 | Yasuhara | |
| 4,421,078 | A | | 12/1983 | Hurner | |
| 4,462,812 | A | * | 7/1984 | Bly et al. | 55/502 |
| 4,495,909 | A | | 1/1985 | Hurner | |
| 4,522,631 | A | * | 6/1985 | Mourao et al. | 44/364 |
| 4,531,363 | A | * | 7/1985 | Ludecke et al. | 60/303 |
| 4,673,412 | A | * | 6/1987 | Stoldt et al. | 44/367 |
| 4,946,609 | A | | 8/1990 | Pruess et al. | |
| 5,085,049 | A | | 2/1992 | Rim et al. | |
| 5,251,564 | A | | 10/1993 | Rim et al. | |
| 5,282,991 | A | * | 2/1994 | Malcolm et al. | 508/185 |
| 5,386,804 | A | | 2/1995 | Guttmann et al. | |
| 5,390,762 | A | | 2/1995 | Nelson | |
| 5,758,496 | A | | 6/1998 | Rao et al. | |
| 5,806,308 | A | | 9/1998 | Khair et al. | |
| 5,927,075 | A | * | 7/1999 | Khair | 60/605.2 |
| 6,248,689 | B1 | | 6/2001 | Manson | |
| 6,329,328 | B1 | | 12/2001 | Koganei et al. | |
| 6,622,480 | B2 | * | 9/2003 | Tashiro et al. | 60/295 |
| 6,629,407 | B2 | * | 10/2003 | Roos et al. | 60/274 |

* cited by examiner

*Primary Examiner*—Thomas Denion
*Assistant Examiner*—Diem Tran
(74) *Attorney, Agent, or Firm*—Carrier, Blackman & Associates, P.C.; William D. Blackman; Joseph P. Carrier

(57) ABSTRACT

A Diesel engine anti-wear lubricant oil additive composition that includes organo-metallic compounds of Cu, Ce, etc., is used to catalytically burn-off diesel particulate matter (PM) collected by diesel particulate filter (DPF). A fuel borne catalyst (FBC) of Cu,Ce,Fe etc., required for regenerating the DPF is made by blending a predetermined quantity of used engine oil, removed from the engine crankcase oil system, with fuel in the fuel tank of a diesel engine equipped with DPF and EGR systems. A method of fumigating water and catalytic compounds of Cu, Fe, Ce, etc., into the air-intake system of a diesel engine in the EGR gases from the DPF or air, to reduce both PM and NOx emissions from a diesel engine, with improved engine lubrication performance, is also disclosed.

14 Claims, 2 Drawing Sheets

SYSTEM FOR AND METHODS OF OPERATING DIESEL ENGINES TO REDUCE HARMFUL EXHAUST EMISSIONS AND TO IMPROVE ENGINE LUBRICATION

BACKGROUND OF THE INVENTION

1. Field of the Invention

The present invention relates to an improved method of operating diesel engines equipped with Diesel Particulate Filter (DPF) and Exhaust Gas Recirculation (EGR) systems, to reduce emissions of Particulate Matter (PM), unburned Hydrocarbons (HC) and Oxides of Nitrogen (NOx) from diesel engines. More specifically, the present invention is related to a catalytic DPF system that improves emissions by filtering exhaust, and which regenerates the filter by burning off collected PM therefrom. This invention is further related to a method of reducing NOx through the use of a cooled EGR gas, as well as introduction of water into a diesel engine combustion system. The present invention also relates to an engine anti-wear lubricating composition, and to a method of employing such engine lubricant oil in internal combustion engines, including diesel engines.

2. Description of the Background Art

In efforts to reduce global-warming gas emissions, energy-efficient internal combustion engines, such as Diesel engines, may be advantageously utilized. Diesel engines have also remained popular, due to their fuel efficiency.

One method of increasing energy efficiency of an internal combustion engine is to reduce frictional energy loss by increasing the engine lubrication performance.

However, it is well known that Diesel engines emit particulate matter (PM) and nitrogen oxides (NOx) in their exhaust gases. A problem exists because concurrent reduction of both PM and NOx from diesel engines is difficult, due to a well-known trade-off relationship between the production of these two emission products in the diesel combustion process.

Diesel engine combustion technology has been greatly advanced with the advent of electronic controls and common-rail injection systems. However, it must be recognized that the engine combustion system alone cannot meet future diesel emissions standards, particularly with regard to PM and NOx.

Unexpectedly, it has recently been discovered that advanced diesel engines emit "ultra-fines"; i.e., finely dispersed particulates, in great numbers. Such finely dispersed particles are believed to be toxic to human health. Moreover, it is well-established now that of the known cures, only the DPF technology, when installed in the diesel exhaust system, can effectively reduce PM, and the related ultra-fines, from diesel engines by a high percentage, such as 99.9% (by particle-counts). Therefore, DPF is going to be required, and is expected to be equipped on all diesel engines, both new and old, throughout the world, beginning in the near future.

Catalytic DPF (CDPF) process have been proposed which include a catalyst in either (1) a catalytic trap that is pre-treated on the trap substrate, or as (2) a fuel-borne catalyst (FBC) where a catalytic component is supplied continuously with fuel, by a metering device connected to a separate additive tank.

Examples of patents relating to CDPF processes include U.S. Pat. No. 6,248,689, "Self-Regenerating Diesel Exhaust Particulate Filter and Material," and U.S. Pat. No. 5,758,496, "Particulate and Exhaust Gas Emission Control System."

DPF technologies, including CDPFs, are generally effective in greatly reducing emissions of PM, but fail to reduce NOx from diesel emissions.

The present applicant's previous patents, U.S. Pat. Nos. 5,085,049 and 5,251,564 teach novel methods of reducing PM, HC, and NOx simultaneously by employing an "active" CDPF system combined with a cooled EGR process. The similar DPF-EGR process, with a "passive" DPF system coupled with hot EGR system, described in U.S. Pat. No. 5,806,308, failed to regenerate the DPF under actual driving conditions. Therefore, an "active" CDPF system, coupled with a cooled EGR system, is needed to guarantee trap regeneration in all driving conditions.

Another method of reducing NOx emissions from diesel engines is to utilize water in the combustion chamber to reduce the peak flame temperature. Water additive methods known in the art include 1) water-injection, 2) water-fuel emulsion, and 3) water-fumigation.

However, water-addition methods including the EGR process are not widely practiced in diesel engine combustion systems, because of concerns about possible engine wear problems caused by the break-down of the protective film of lubricating oil by contact with water in critical rubbing metal surfaces, such as the surfaces between piston rings and cylinder walls and valve bearings, etc. It is, therefore, desirable to develop more effective engine lubricating oil compositions, and lubricating systems that will function better under the presence of water in diesel engine combustion systems.

A lubricant oil composition especially suitable for a pressure-accumulating (common rail) type diesel engine with an EGR system was proposed by U.S. Pat. No. 6,329,328 in which organomolybdenum coumpound, zinc dialkyl dithiophosphate, and Ca or Mg and Zn salts of alkyl salicylate are incorporated with a base oil composed of a mineral and/or synthetic oil.

U.S. Pat. No. 4,946,609 discloses an engine lubricating oil for diesel engines equipped with a DPF in the exhaust gas system, consisting of diesel engine lubricating oil and 5–20,000 ppm, based on said engine lubricating oil, of an iron compounds of ferrocene and/or a ferric salt of tall oil. The use of diesel engine lubricating oil containing iron compounds, as shown in U.S. Pat. No. 4,946,609, is not always sufficient for inducing catalytic regeneration of the collected PM in all driving modes.

Similarly, U.S. Pat. No. 5,386,804 discloses a process for the addition of ferrocene to combustion or motor fuels, using improved metering of the additive into the combustion chamber.

For internal combustion engines such as diesel engines, it is possible to periodically direct controlled amounts of used crankcase oil to the fuel tank, where the used oil mixes with the fuel, and is burned therewith during engine combustion. There are many methods of implementing automatic crankcase oil change and makeup systems, such as those disclosed in as U.S. Pat. Nos. 5,390,762; 4,495,909; 4,421,078; and 4,417,561. However, burning used engine oil in diesel fuel, by the methods disclosed in these patents, emits more air-pollutants, and is not allowed in some countries without use of DPF system.

An improved CDPF system is therefore needed, which would more effectively reduce unwanted pollutants. In particular, a CDPF system is needed which is operable to reduce emissions of both PM and $NO_x$ simultaneously.

It would be advantageous if a CDPF system were available which could beneficially improve engine oil lubricity and effectiveness.

SUMMARY OF INVENTION

The present invention provides an emissions-reduction system for diesel engines which are equipped with DPF and EGR.

The system according to the invention may incorporate an improved engine lubricating oil composition that facilitates DPF regeneration, and also has anti-wear properties. The present invention also relates to a method of using such engine lubricating oil in diesel engines.

The emissions-reduction system according to the present invention also provides an optional method of supplying water vapor and a catalyst to a diesel engine's intake manifold, via the EGR system, to reduce NOx formation from diesel exhaust gases, without causing an engine wear problem.

It has been discovered that the use of an engine lubricant oil additive composition added to engine oil in the oil sump, part of which is later transferred to the fuel tank, extends the useful life of the diesel particulate filter in the exhaust system by lowering the ignition temperature of PM colleted by DPF during regeneration, while also providing superior lubricating properties for diesel engines equipped with a DPF system according to the present invention. The additive composition hereof includes one or more organo-metallic compounds of Cu, Ce, Pb, Mn, Zn, in a range of about 0.05% to 10%, a preferred range of about 0.1% to about 6%, or a most preferred range of about 0.1% to about 2% by weight of the total weight of the oil.

The present invention also provides an alternate method of using a fuel-borne catalyst (FBC) for diesel engines equipped with DPF, by mixing a predetermined amount of catalyst into engine oil in the engine oil sump, and subsequently feeding a controlled amount of such catalyst-loaded oil from the engine oil sump into the fuel tank. This lowers the ignition temperature of PM collected by the DPF.

The system according to the invention also teaches routing a gaseous fluid, which may be air or a cooled EGR gas-stream from the DPF, through a water and catalyst solution in the EGR accumulator and thence into the combustion chamber. The EGR accumulator contains water-soluble catalytic compounds of Cu, Ce, Fe, etc. in a 1–10% water solution, and after EGR travels through this solution, both water vapor and catalytic components are fed into diesel engine combustion system equipped with DPF and EGR to reduce both PM, HC and NOx from the diesel exhaust gases.

For a more complete understanding of the present invention, the reader is referred to the following detailed description section, which should be read in conjunction with the accompanying drawings. Throughout the following detailed description and in the drawings, like numbers refer to like parts.

DETAILED DESCRIPTION

Figure 1:
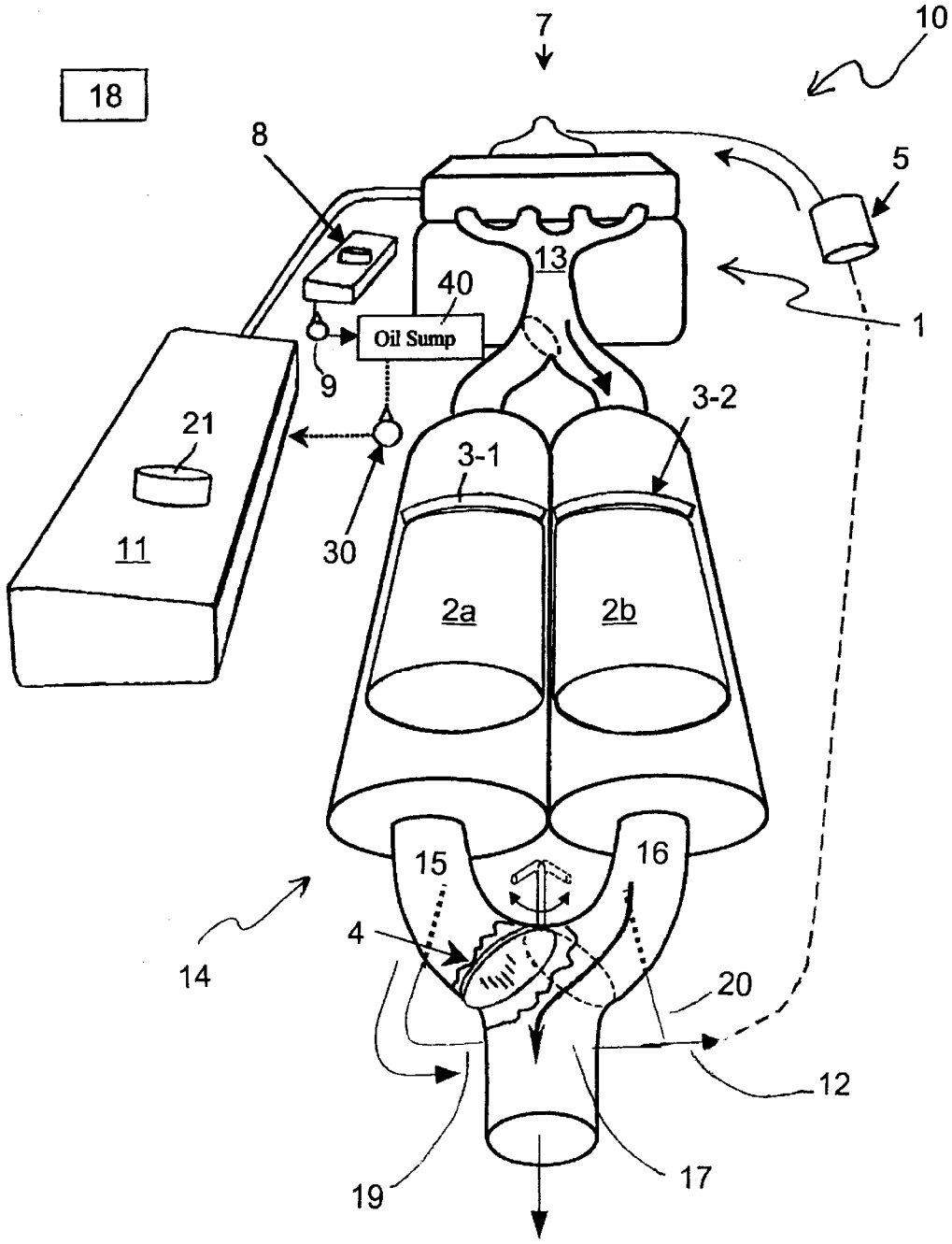
FIG. 1 is a schematic depiction, primarily shown in perspective, of an emissions reducing system according to an illustrative embodiment of the present invention.

Referring now to the Drawings, FIG. 1 generally shows an overview of an emissions reducing system (10) according to one illustrative embodiment of the present invention.

It will be understood that the emissions reducing system (10) according to the present invention is intended to be installed on a vehicle (not shown).

The emissions reducing system (10) according to the present invention is an improvement of the system taught by this applicant's previous U.S. Pat. Nos. 5,085,049 and 5,251,564. The complete disclosures of U.S. Pat. Nos. 5,085,049 and 5,251,564 are incorporated by reference, as though fully set forth herein.

The emissions reducing system (10) according to the present invention is provided for use on a diesel engine (1), as shown schematically in the drawing. The core mechanical components of the diesel engine (1) operate conventionally, using commercially available diesel fuel in the fuel tank (11). The fuel may or may not be treated with a catalyst, and may be made up entirely of commercial diesel fuel from a filling station. Alternatively, the fuel in the tank (11) may be a fuel blend including alcohol, water-emulsion, and/or bio-diesel. The engine (1) draws in air for combustion through its air intake (7).

The emissions reduction system (10) also includes a catalytic additive storage tank (8) and a first metering pump (9) for adding a measured amount of catalytic additive solution to oil in the oil sump (40).

The emissions reducing system (10) also includes an electronic control unit (18), which includes a microprocessor. Although wires connecting the control unit (18) to other components of the system (10) have been omitted from the drawing, it will be understood that the control unit is connected to multiple sensors and control devices using wires. Those in the art will be familiar with such sensors and control devices, since they are widely used in the automotive industry today. Optionally, the control unit (18) may be made part of the main engine control module (ECM) or powertrain control module (PCM) of the vehicle.

Combustion by-products, in the form of various exhaust gases including PM, HC, ultra-fines, and NOx, exit the Diesel engine through an exhaust manifold (13), and enter an exhaust filtration assembly (14). The exhaust filtration assembly (14) includes two separate branches, only one of which operates at a given time, as further detailed in the applicant's previous patents. In this way, one branch of the assembly can be in regeneration mode, while the other side is in collection mode.

The exhaust filtration assembly (14) includes first and second independent filter elements **(2*a*, 2*b*) that alternate in collecting PM during engine operation, while a single exhaust diverter valve (4), located downstream of the filter elements, pivotally moves in the filter exhaust port (17) to direct the flow of exhaust through the assembly (14). Optionally, if desired, a second diverter valve (shown in phantom in FIG. 1**) may be used upstream of the filter elements.

In the embodiment depicted in FIG. 1, the diverter valve (4) is shown in the left position, blocking exhaust from flowing through the first filter element **(2*a*), so the exhaust is forced through the second filter element (2*b*), accumulating PM on the surface thereof nearest to the engine (1). PM, including ultrafines, continues to build up on the surface of the second filter element (2*b*) until backpressure, upstream of the filter element, reaches a predetermined threshold value. Appropriate sensors are provided for sensing such backpressure and communicating the sensed value to the control unit (18)**.

When it reaches the time to regenerate a filter **(2*b*), as indicated by an increase in back-pressure before the filter, the control unit (18) causes the position of the diverter valve (4) to be changed from the left side to the right side, in order to allow exhaust gas to flow through the left branch of the filtration assembly (14)** and to block the flow of exhaust gas through the right branch of the filtration assembly.

A glow plug or other electric igniter (3-2) is then turned on to start the regeneration process in the branch which has been newly blocked off, burning off collected PM from the regenerating filter (2*b*). The presence of the appropriate catalyst in the PM accumulated on the filter (2*b*) allows the ignition temperature thereof to be lowered to a value in the range of 250 to 400 degrees C.

Since normal exhaust flow is now blocked, substantially all of the combustion by-products from the filter regeneration exit through the EGR port (20), connected to the EGR tube (12) that is extended to the EGR accumulator tank (5). These combustion by-products are passed through the EGR accumulator tank (5), and are then drawn by intake manifold vacuum into the intake 7, and are subsequently fed into the combustion chambers with the air of combustion.

Figure 2:
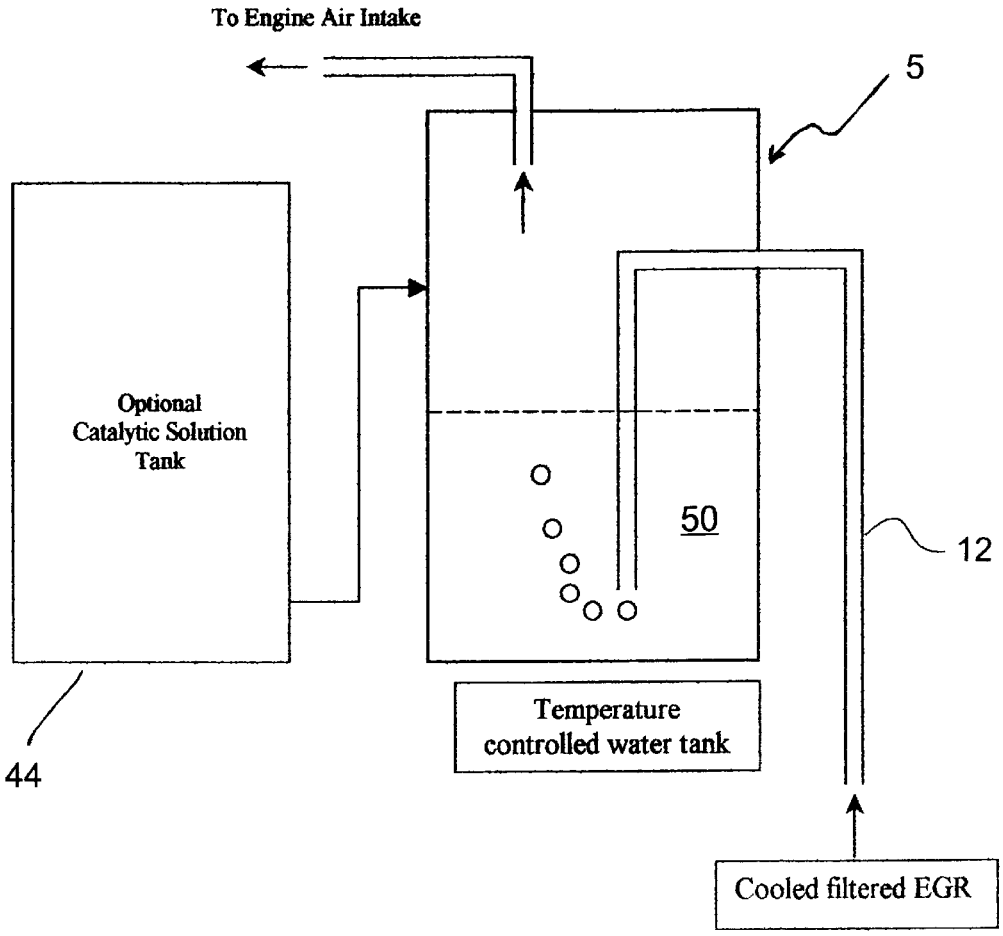
FIG. 2 is a schematic depiction of an EGR accumulator which is a component of the system of FIG. 1, showing the path of EGR gases bubbling through a catalytic-water solution therein.

Referring now to FIG. 2, it will be seen that in the EGR accumulator tank (5), EGR gases are directed from the EGR tube (12) through a catalytic water solution (50). This catalytic water solution (50) may include water-soluble catalytic elements of Cu, Ce, or Fe in about 1% to about 10% of the total weight of the solution.

After leaving the accumulator tank (5), the EGR gases are introduced to the air-intake (7) to be combusted again in the Diesel engine (1). If desired, an optional catalytic water storage tank (44) can be used to replenish the solution in the accumulator (5), as needed.

With completion of the filter regeneration cycle, the diverter valve may, optionally, be moved to a neutral position, between the two branches of the exhaust flow port (17), and the electric igniter (3-1) may then be turned off. The filtering operation is continued by the two filters (2*a*, 2*b*) with filtered exhaust gases exiting through two exhaust pipes at (15) and (16), and (17). When it is time for the other filter (2*b*) to be regenerated, the diverter valve (4) is moved to the other side (16) and the correlating electric igniter (3-2) is then turned on.

While the filtered exhaust gases pass through the exhaust port (17) and exit to the atmosphere, the by-products from the regenerating filter (2*b*) are taken out to the intake (7) via the exhaust port (20), which is connected to the EGR tube (12).

When the empty fuel tank (11) is filled with fuel by opening the filler-cap (21), the action of removing the filler-cap signals the micro engine-oil pump (30) to pump out a pre-determined quantity of used engine-lubricant oil from the engine crankcase oil sump (40) into the fuel tank. As a result, catalytic compounds, originally introduced as engine anti-wear additives for the lubricating oil, are mixed in with the freshly added fuel, to form the fuel-borne catalyst to be combusted in the diesel engine (1). The spent engine oil can be replenished by a make-up oil pump (9) connected to catalytic oil tank (8). This provides a catalytic additive to the oil in an amount ranging from about 0.1% to about 2% of the total weight of the final composition. Examples of suitable additives which may be used in the oil include cerium carboxylate, copper acetate, and copper naphthanate.

The following Example should help illustrate the operation of the method and apparatus according to the invention.

EXAMPLE 1

Referring to FIG. 1, dual filters, with each filter made of Coming Diesel particulate filter, 5.66 in. diameter×6 in. long, 100 cells/ sq. in. was canned in the conventional manner, with an electric coil installed in front of the filter.

The flow of exhaust gases and EGR gas was controlled by the diverter valve in the exhaust system, as shown in FIG. 1. EGR gases from the DPF are fed into the air-intake port via the step of bubbling through the water solution in the EGR-accumulator tank, which is filled with 2 liters of water containing 50 grams of copper acetate, and a trace of ethylene glycol to prevent freezing at cold temperatures.

All the features of this invention process were installed on a Mercedes 300 D with a diesel engine, 3.0 liters of engine displacement. The test fuel was a regular diesel fuel with 300–400 ppm sulfur present in the fuel. The engine oil used was a regular engine lubricant, 10W-40 viscosity suitable for diesel engines, to which the engine oil additive of this invention, which included equal amounts of copper naphthanate and cerium carboxylate was added, to give an additive in an amount of 2 percent of the total oil weight.

The effect of this invention process was measured according to the standard emission test of the Federal Test Procedure FTP-74 CVS method, at an EPA registered emissions laboratory in the US. As shown in the table below, this invention process significantly reduced both PM and NOx emissions.

TABLE 1

| Diesel Emissions Test Result in grams/km | |
|---|---|
| HC | 0.26 |
| CO | 0.81 |
| NOx | 0.30 |
| PM | 0.013 |
| Fuel Economy (mpg): 31.2 | |

Although the present invention has been described herein with respect to a specific illustrative embodiment, the foregoing description is intended to be illustrative, and not restrictive. Those skilled in the art will realize that many modifications of the preferred embodiment could be made which would be operable. For instance, both filters could be actively filtering simultaneously with both filters being regenerated and a portion of exhaust gas from diesel engine can be by-passed the filter to the atmosphere during at least some portion of the normal duty time of one of them. Also, rather than routing by conduit the by-product of regeneration of the inactive filter to the EGR-accumulator, the by-products could be introduced by conduit into the air intake of the Diesel engine. The EGR-accumulator can be fed with the EGR gases or a separate source of air.

All such modifications, which are within the scope of the claims, are intended to be within the scope and spirit of the present invention.

What I claim is:

1. An engine lubricating oil composition for a diesel engine fitted with a diesel particulate filter and an exhaust gas re-circulating system in an exhaust system connected to said engine, said lubricating oil composition comprising a diesel engine lubricating oil and a catalyst additive comprising cerium carboxylate, wherein said catalyst additive is operable to catalyze oxidative regeneration of said particulate filter, and wherein said catalyst additive is present in a range of about 0.05% to 10%, by weight of the total weight of the oil.

2. The composition of claim 1, wherein the catalyst additive is present in a range of about 0.1% to about 6% of the total weight of the composition.

3. The composition of claim 1, wherein the catalyst additive is present in a range of about 0.1% to about 2% of the total weight of the composition.

4. A method for the lubrication of a diesel engine which comprises the step of lubricating a diesel engine, fitted with a diesel particulate filter, with the lubricating oil composition of claim 1.

5. A method of operating a diesel engine fitted with a diesel particulate filter, comprising the steps of:

adding an oil-soluble catalytic additive to oil in the engine;

transferring a measured amount of engine oil, containing said catalytic additive, from said engine to diesel fuel in a fuel tank;

burning fuel from the fuel tank in the diesel engine to produce exhaust; and trapping particulate matter from said exhaust on said diesel particulate filter; and igniting said trapped particulate matter to regenerate said particulate filter;

whereby a small amount of said catalytic additive is present in said particulate matter to catalyze ignition thereof during regeneration of said diesel particulate filter;

wherein said regeneration creates PM combustion products, further comprising a step of routing said PM combustion products from said particulate filter into an intake manifold of said engine;

and further comprising an intermediate step of passing said PM combustion products through a water bath in an EGR accumulator.

6. The method of claim 5, wherein said water bath contains a catalytic water solution comprising a water-soluble catalytic compound of Cu, Ce, or Fe therein.

7. An improved method of operating a diesel particulate filter coupled with a cooled EGR process by the use of a single diverter valve located downstream of dual filters in a diesel particulate filter system, said method comprising the steps of trapping particulate matter from diesel exhaust on a diesel particulate filter; and igniting said trapped particulate matter to regenerate said particulate filter;

wherein a small amount of a catalytic additive is present in said particulate matter to catalyze ignition thereof during regeneration of said diesel particulate filter;

wherein said regeneration creates PM combustion products, and further comprising a step of routing said PM combustion products from said particulate filter into an intake manifold of said engine;

and further comprising an intermediate step of passing said PM combustion products through a water bath in an EGR accumulator.

8. The method of claim 7, wherein said water bath contains a catalytic water solution comprising a water-soluble catalytic compound of Cu, Ce, or Fe therein.

9. An emissions reduction system for a diesel engine equipped with an intake manifold and an oil sump, said system comprising:

a first metering pump for pumping a measured amount of oil from said oil sump to a fuel tank;

a bifurcated filtering exhaust assembly having a first branch with a first particulate filter therein and a second branch with a second particulate filter therein, said exhaust assembly comprising a diverter valve located downstream of said first and second filters for limiting exhaust flow through said assembly to one of said branches;

an EGR accumulator tank for holding a water bath;

an EGR tube for connecting said exhaust assembly to said EGR accumulator tank; and a conduit for conducting a gas from said accumulator tank to said intake manifold.

10. A method of operating a diesel engine in a vehicle having a fuel tank and a diesel particulate filter, comprising the steps of:

adding an oil-soluble catalytic additive to oil in the diesel engine;

transferring a measured amount of engine oil containing said catalytic additive from said diesel engine to fuel in the fuel tank;

burning fuel from the fuel tank in the diesel engine to produce exhaust;

trapping particulate matter from said exhaust on said diesel particulate filter; and igniting said trapped particulate mater to regenerate said particulate filter;

whereby a small amount of said catalytic additive is present in said particulate matter to catalyze ignition thereof during regeneration said diesel particulate filter; wherein said regeneration creates PM combustion products, and routing said PM combustion products from said particulate filter into an intake manifold of said engine;

and further comprising an intermediate step of passing said PM combustion products through a water bath in an EGR accumulator.

11. The method of claim 10, wherein said water bath contains a catalytic water solution comprising a water-soluble catalytic compound of Cu, Ce, or Fe therein.

12. A method of operating a diesel particulate filter coupled with a cooled EGR process in a diesel particulate filter system, said method comprising the steps of trapping particulate matter from diesel exhaust on a diesel particulate filter; and igniting said trapped particulate matter to regenerate said particulate filter;

wherein a small amount of a catalytic additive is present in said particulate matter to catalyze ignition thereof during regeneration of said diesel particulate filter;

wherein said regeneration creates PM combustion products, and further comprising a step of routing said PM combustion products from said particulate filter through a water bath in an EGR accumulator, and into an intake manifold of said engine.

13. The method of claim 12, wherein said water bath contains a catalytic water solution comprising a water-soluble catalytic compound of Cu, Cc, or Fe therein.

14. A method of operating a diesel engine in a vehicle having a fuel tank and a diesel particulate filter, comprising the steps of:

adding an oil-soluble catalytic additive to oil in the diesel engine;

using a pump to transfer a measured amount of engine oil containing said catalytic additive from said diesel engine to fuel in the fuel tank;

burning fuel from the fuel tank in the diesel engine to produce exhaust;

trapping particulate matter from said exhaust on said diesel particulate filter; and igniting said trapped articulate matter to regenerate said particulate filter;

whereby a small amount of said catalytic additive is present in said particulate matter to catalyze ignition thereof during regeneration said diesel particulate filter;

wherein said regeneration creates PM combustion products; passing said PM combustion products through a water bath in an EGR accumulator; and routing said PM combustion products into an intake manifold of said engine;

wherein said water bath contains a catalytic water solution comprising a water-soluble catalytic compound of Cu, Ce, or Fe therein.

* * * * *